US005299971A

United States Patent [19]

Hart

[11] Patent Number: 5,299,971

[45] Date of Patent: Apr. 5, 1994

[54] INTERACTIVE TRACKING DEVICE

[76] Inventor: Frank J. Hart, 2811 Mark Ave., Santa Clara, Calif. 95051

[21] Appl. No.: 813,089

[22] Filed: Dec. 24, 1991

Related U.S. Application Data

[63] Continuation-in-part of Ser. No. 525,698, May 21, 1990, Pat. No. 5,083,968, which is a continuation-in-part of Ser. No. 277,203, Nov. 29, 1988, Pat. No. 4,930,236.

[51] Int. Cl.[5] ..... G08B 19/00

[52] U.S. Cl. ..... 446/484; 446/14; 901/1; 901/46; 180/167

[58] Field of Search ..... 446/14, 130, 431, 433, 446/441, 484; 180/167, 169; 901/1, 96; 340/552, 556, 557

[56] References Cited

U.S. PATENT DOCUMENTS

| | | | |
|---|---|---|---|
| 2,700,318 | 1/1955 | Snyder | 88/1 |
| 2,961,545 | 11/1960 | Astheimer et al. | 250/203 |
| 3,703,718 | 11/1972 | Berman | 340/258 |
| 3,760,399 | 9/1973 | Schwarz | 340/258 |
| 3,924,130 | 12/1975 | Cohen et al. | 250/342 |
| 4,769,545 | 9/1988 | Fraden | 250/353 |
| 4,772,875 | 9/1988 | Maddox et al. | 180/167 X |
| 4,823,051 | 4/1989 | Young | 315/155 |
| 4,890,093 | 12/1989 | Allison et al. | 340/567 |
| 4,896,039 | 1/1990 | Fraden | 250/342 |

*Primary Examiner*—Robert A. Hafer
*Assistant Examiner*—Sam Rimell
*Attorney, Agent, or Firm*—Richard C. Litman

[57] ABSTRACT

An automatic passive interactive tracking device is disclosed which provides for the detection of intruders with a single quadruplex stationary passive infrared sensor covering a relatively wide field of view. Alternatively, two dual sensors may be incorporated. The stationary sensor or sensors provides a signal to a microcontroller, which drives a stepper motor to rotate additional sensors with narrower fields of view to more precisely determine the exact bearing of the intruder. By incorporating appropriate analog to digital conversion and algorithms in the microcontroller, approximate range may also be determined. When the intruder has been verified by all of the sensors, a camera and/or light is activated to record the intruder. A number of the tracking devices may be linked together to cover a larger area, and may provide signals to a remotely located monitor and/or security post. As each device requires only a single camera and no human operator, great savings may be achieved in the costs involved in such security. Alternative embodiments provide for a sonic emitter, directional laser or strobe light to frighten intruders such as animals in agricultural areas, and provision may be made for a portable unit for police surveillance and/or traffic monitoring.

16 Claims, 3 Drawing Sheets

INTERACTIVE TRACKING DEVICE

REFERENCE TO RELATED APPLICATIONS

This application is a continuation in Part of U.S. patent application Ser. No. 07/525,698 filed on May 21, 1990 and now U.S. Pat. No. 5,083,968, which allowed application was a continuation in part of U.S. patent application Ser. No. 07/277,203 filed Nov. 29, 1988, which issued as U.S. Pat. No. 4,930,236 on Jun. 5, 1990.

FIELD OF THE INVENTION

This invention relates generally to automated tracking devices, and more specifically to an automated device using a small number of cooperating passive infrared sensing devices to provide signals for the activation and operation of surveillance, warning and/or animal repelling devices.

BACKGROUND OF THE INVENTION

The monitoring of areas for various purposes, such as traffic control, animal or human intrusion deterrence, and/or surveillance for security or other purposes, has become increasingly important with population increases and the pressures of a more complex society. Such concerns are often apparent to the observer, who may readily note remote camera installations and security guards and personnel in banks, shopping malls and other areas, as well as pneumatic or other traffic monitoring devices on the road. Such devices and services can be relatively costly, particularly in the case of monitoring or security personnel. However, in some situations there have been no suitable alternatives to such personnel due to the relatively high power demands of many security systems, such as floodlighting for camera surveillance, etc., as well as the need for human observation.

Additionally, it is well known that an intruder (particularly an animal) may often be frightened away by sudden sounds or noises, and in fact this technique has been used with some success with both human intruders and also in areas such as airports and agricultural areas to keep birds and other animals clear of the area. However, these devices generally operate on a timed basis, whether they are needed at the moment or not. Such systems are wasteful of power and distracting, to say the least, to those working in the vicinity if they are not deactivated.

The need arises for a tracking system which is capable of operating upon demand, i.e., when an intruder or intruders approach the area covered by the system. The system should require relatively low power in normal use, as the additional power required for lights, audio devices, cameras, etc. need only be supplied when required by the primary sensing means. The primary sensing means should be of a passive nature, which renders such sensing means more difficult to detect, as well as further reducing power demands. Moreover, the system should be relatively inexpensive to manufacture and operate in comparison to other systems developed.

DESCRIPTION OF THE RELATED ART

H. L. Berman U.S. Pat. No. 3,703,718 for an Infrared Intrusion Detector System discloses a system using a single passive infrared (PIR) detector and a series of mirrors or lenses to broaden the field of coverage of the detector. While the system may be activated by the passage of a heat source across the mirror or lens array, no means is provided to pinpoint the direction of the heat source nor to activate any camera or recording means.

F. Schwarz U.S. Pat. No. 3,760,399 for an Intrusion DetecDetector discloses a thermopile sensor comprising a plurality of thermocouples. While the sensor means is somewhat different than the PIR sensor of the Berman patent discussed above, the lack of provision for pinpointing a specific direction to a detected heat source renders this device unsuitable for use in combination with a camera or the like.

J. Snyder U.S. Pat. No. 2,700,318 for a Gun Muzzle Blast Azimuth Indicator discloses two parallel passive infrared (PIR) detector system with graduated lenses or filters. A circuit compares the signal strength detected by each PIR and determines azimuth based upon the relative signal strength provided by the graduated lenses. The device provides great accuracy, but is limited to a relatively narrow field of view.

R. W. Astheimer et al. U.S. Pat. No. 2,961,545 for a Tracker for Moving Objects discloses a relatively complex device for use in tracking rockets and the like. The device includes four wide angle PIR detectors to scan a 360 degree field of view, and two additional detectors for a relatively narrow field. No means is provided to interface cameras, alarms or the like.

J. F. Maddox et al. U.S. Pat. No. 4,772,875 discloses an Intrusion Detection System which includes a plurality of sensors in a horizontal radial array, with additional sensors rotatable relative to the first sensor array. The device is incapable of continually scanning a given field due to the need to physically rotate the second sensor array to confirm any detection provided by the first array, and the resultant time such rotation requires. Moreover, the Maddox et al. device is relatively costly, having a plurality of different types of sensors and means providing mobility. Such mobility means appear to restrict the device to a relatively smooth and level surface, such as the interior of a warehouse or other building, whereas the present invention may be installed in virtually any area. Moreover, the Maddox et al. device makes no provision for lighting the surrounding area or providing an audible alert or alarm.

A. Cohen et al. U.S. Pat. No. 3,924,130 discloses a Body Exposure Indicator which may detect infrared radiation from intruders or other sources in the field covered by the device. However, in order for the device to detect such an anomaly, the standard field of view must first be mapped and entered into memory, whereupon the device may compare the normal field as recorded in the memory with the field scanned at any given time. The resulting requirement for memory, and the periodic updating of that memory for changing conditions, increases the complexity of the Cohen et al. device considerably over the present invention.

J. Fraden U.S. Pat. No. 4,769,545 discloses a Motion Detector based upon a passive infrared (PIR) device. The Fraden patent is primarily directed to the specific construction of such a device, rather than its application in a surveillance apparatus. No recording or alarm means are disclosed.

W. A. Young U.S. Pat. No. 4,823,051 discloses an Infrared Actuated Control Switch Assembly comprising two conically shaped fields of view of wide and narrow extent. Each of the fields of view includes 360 degrees, and is intended to sense the presence of a person entering or leaving a room in order to activate or deactivate a light switch. However, no provision is made for determining the specific direction of a person relative to the sensor means, as in the present invention.

J. R. Allison et al. U.S. Pat. No. 4,890,093 discloses a Solar Powered Proximity Triggered Light. This device relies upon a solar charged battery for electrical power, rather than power from conventional electric cables or wiring. The inherent disadvantages of a battery and the occasional maintenance required, as well as the need for a radio transmitter to alert personnel of an intrusion, limit the Allison et al. device when compared to the present invention. Moreover, the Allison et al. device also provides that any night illumination which might otherwise be activated by the device when triggered, will remain deactivated in the event of low battery charge. While such provision is necessary in the Allison et al. device in order to assure sufficient power to alert personnel via the radio transmitter, it obviously seriously limits the device when used for intrusion detection at night.

Finally, J. Fraden U.S. Pat. No. 4,896,039 discloses an Active Infrared Motion Detector and Method For Detecting Movement. This device utilizes an active infrared detector device, which transmits an infrared signal above ambient temperature and detects any reflected radiation at that temperature (wavelength) to determine any intrusion. The need for a consistent infrared source, as well as the transmission of infrared radiation which might be detected by an intruder, are potential problems obviated by the use of passive infrared by the present invention.

None of the above noted patents, either singly or in combination, are seen to disclose the specific arrangement of concepts disclosed by the present invention.

SUMMARY OF THE INVENTION

By the present invention, an improved passive infrared tracking device is disclosed.

Accordingly, one of the objects of the present invention is to provide an improved passive infrared tracking device which may be used for a variety of purposes, such as surveillance of intruders, deterring animals by means of sonic devices, and automatically tracking an intruder with a light and/or camera.

Another of the objects of the present invention is to provide an improved passive infrared tracking device which may use a single stationary passive infrared detection device, or two cooperative stationary passive infrared detection devices, in combination with two axially movable passive infrared detectors.

Yet another of the objects of the present invention is to provide an improved passive infrared tracking device which provides for detection of an intruder throughout an arcuate range of at least 180 degrees.

Still another object of the present invention is to provide an improved passive infrared tracking device which may provide some indication of target range by means of appropriate microprocessor and/or computer programming.

A further object of the present invention is to provide an improved passive infrared tracking device which does not require the intervention of a human operator.

An additional object of the present invention is to provide an improved passive infrared tracking device which is capable of operation in either light or darkness by means of lights actuated by the device and/or infrared or low light cameras.

Another object of the present invention is to provide an improved passive infrared tracking device which requires relatively little electrical power until actuated by an intruder.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
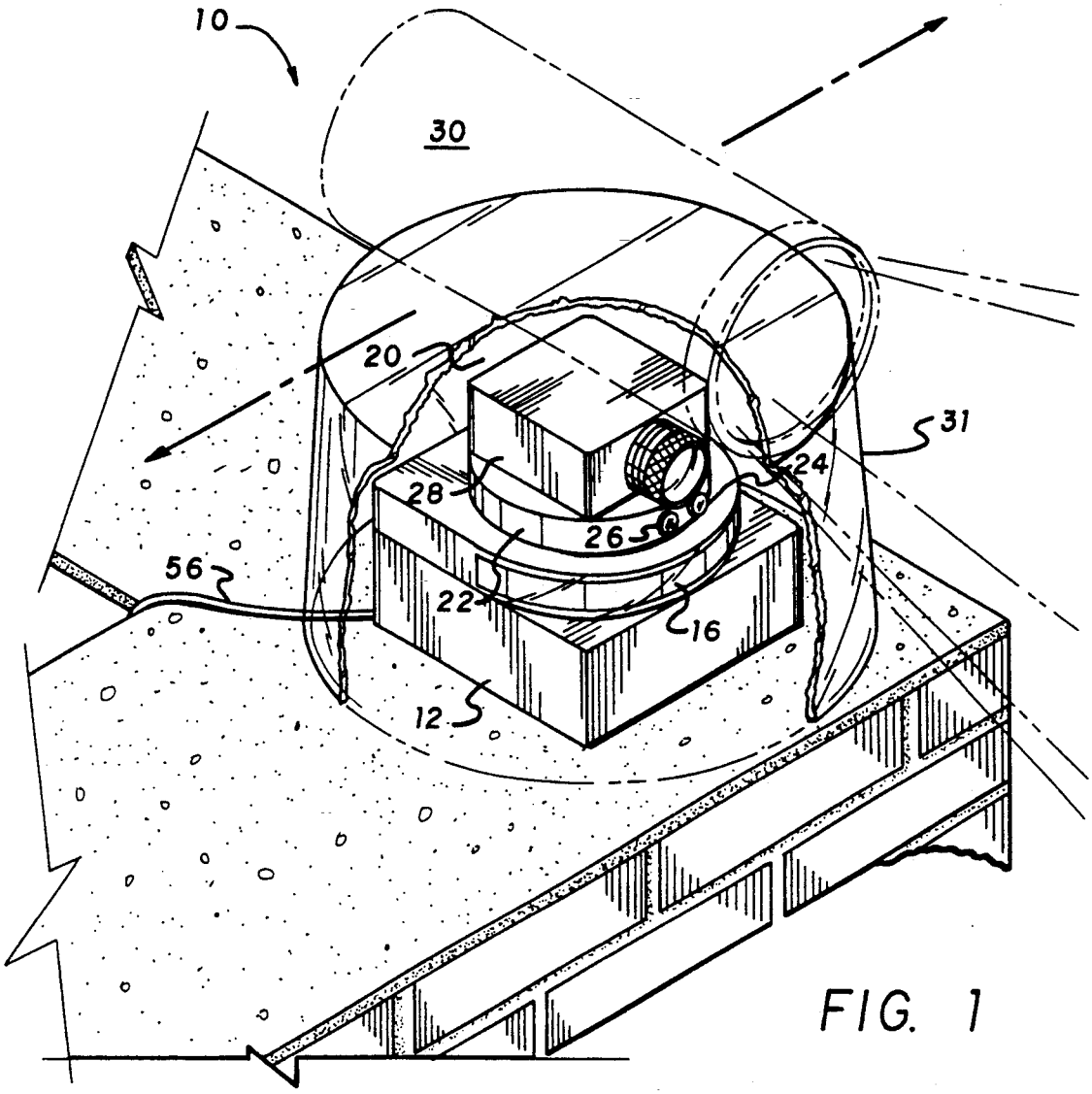
FIG. 1 is a perspective view of the present invention showing its various major components.

Referring now to the drawings, particularly FIG. 1 of the drawings, the present invention will be seen to relate to a passive interactive tracking device 10 which utilizes passive infrared detection devices (hereinafter referred to as PIRs) for the detection of intruding heat sources. The PIR devices incorporated in the present invention do not transmit any radiation, as in the case of active devices which depend upon the reception of reflected energy returned from objects in their field of view; radar is a well known example of such active transmission devices.

The incorporation of passive devices in the present invention provides for lower cost, as no transmission means need be provided. As all warm blooded animals (including persons) emit at least some heat or infrared radiation, depending upon the size and body temperature of the animal, this emitted radiation may be used to sense the presence of an intruder or intruders by means of such PIR devices.

Device 10 comprises a stationary portion 12, which contains a stepper motor 14, stationary PIR device 16 and other associated circuitry. The precision provided by a stepper motor 14 for the operation of tracking device 10 is highly desirable, in that the digital circuitry can precisely rotate such a stepper motor 14 to provide accurate aim for the associated components described below. Stepper motor 14 has a vertical shaft 18 which extends upward through the area containing stationary PIR device 16 to drive a rotatable portion 20 of tracking device 10. The general arrangement of components included in stationary portion 12 of the present invention is essentially the same in each of the embodiments.

Figure 2:
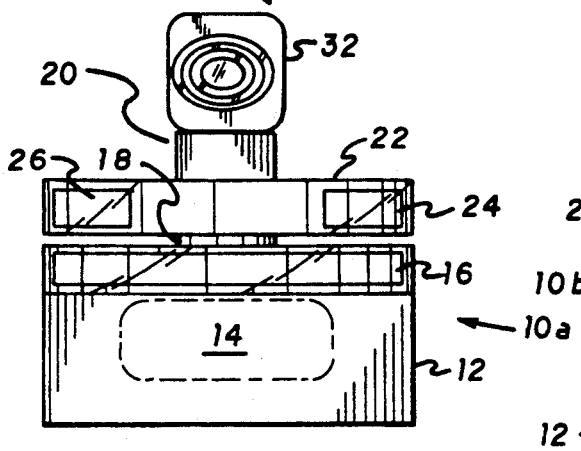
FIG. 2 is a front view of a second embodiment of the present invention incorporating a sonic emitter.
Figure 3:
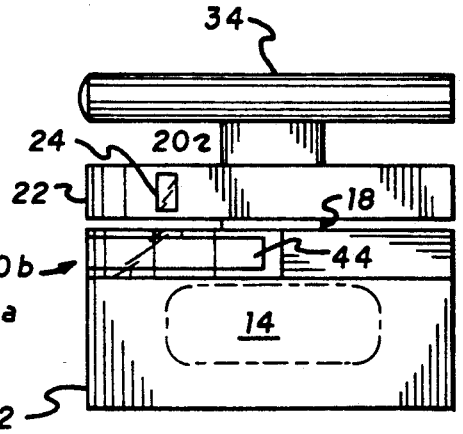
FIG. 3 is a side view of an alternate embodiment of the invention shown in FIG. 2, incorporating a directional laser.

Rotatable portion 20 includes at least a platform 22 containing two PIR devices 24 and 26 each of which are provided with a relatively narrow field of view. Other surveillance equipment, such as the camera 28 and flood light 30 of tracking device 10 of FIG. 1, may be included with the rotary platform 22 and rotate in unison with it. A shell 31 which is transparent to the appropriate frequencies by means of a half silvered surface or other means, may be provided to protect and/or conceal the components of device 10. Other devices, such as a sonic emitter 32 as shown in the embodiment 10*a* of FIG. 2 or directional laser 34 of the embodiment 10*b* of FIG. 3, may be provided in addition to or in lieu of the camera 28 and/or spotlight 30 of tracking device 10 of FIG. 1.

Figure 4A:
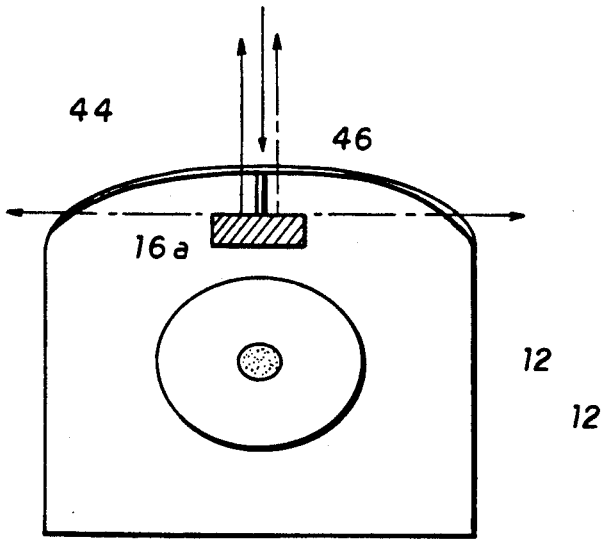
FIG. 4A is a top plan view in section of the stationary detection portion of the present invention incorporating a single passive infrared detector incorporating a single quadruplex sensor.
Figure 4B:
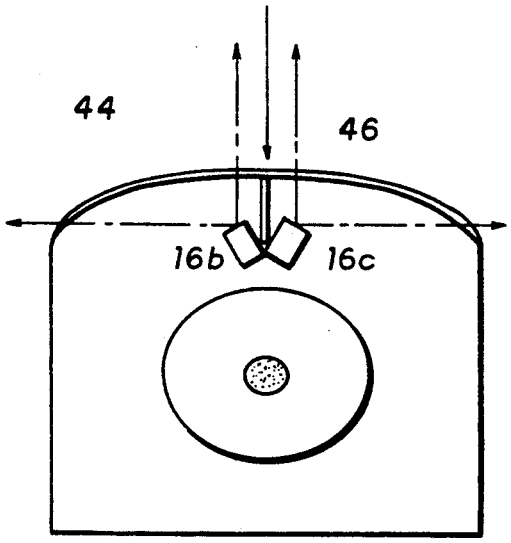
FIG. 4B is a top plan view of an alternative embodiment of the device of FIG. 4A, in which two dual passive infrared detectors are incorporated.

FIGS. 4A and 4B disclose slightly different means of providing the stationary PIR of the present invention. In FIG. 4A a single quadruplex ("quad") PIR 16*a* is shown, while FIG. 4B discloses a similar unit modified by using two dual PIRs 16*b* and 16*c*. The essential function and circuitry of either PIR 16*a* or 16*b* is the same and either may be used in combination with the other various components comprising the present invention.

Figure 5:
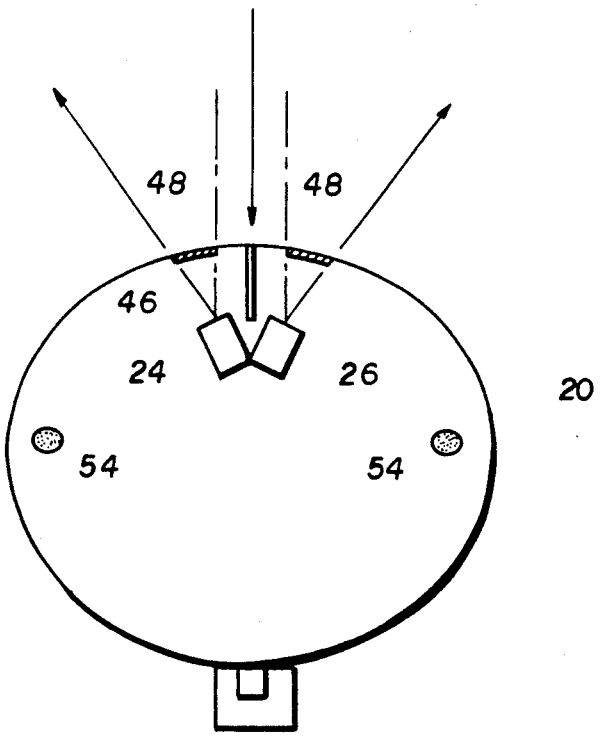
FIG. 5 is a top plan view of the rotating sensor portion of the present invention.

FIG. 5 discloses the basic components of rotatable platform 22, which will be seen to include a pair of dual PIRs 24 and 26. However, a single quad PIR 16*a* may be substituted in the same manner as that used for the PIR devices of the stationary portion 12. The important point is that the PIR or PIRs provide, either inherently or by means of the proper circuitry, for the determination of the direction of a detected heat source relative to the centerline of the PIR or PIRs. The present invention provides for such determination, as will be explained below.

Figure 6:
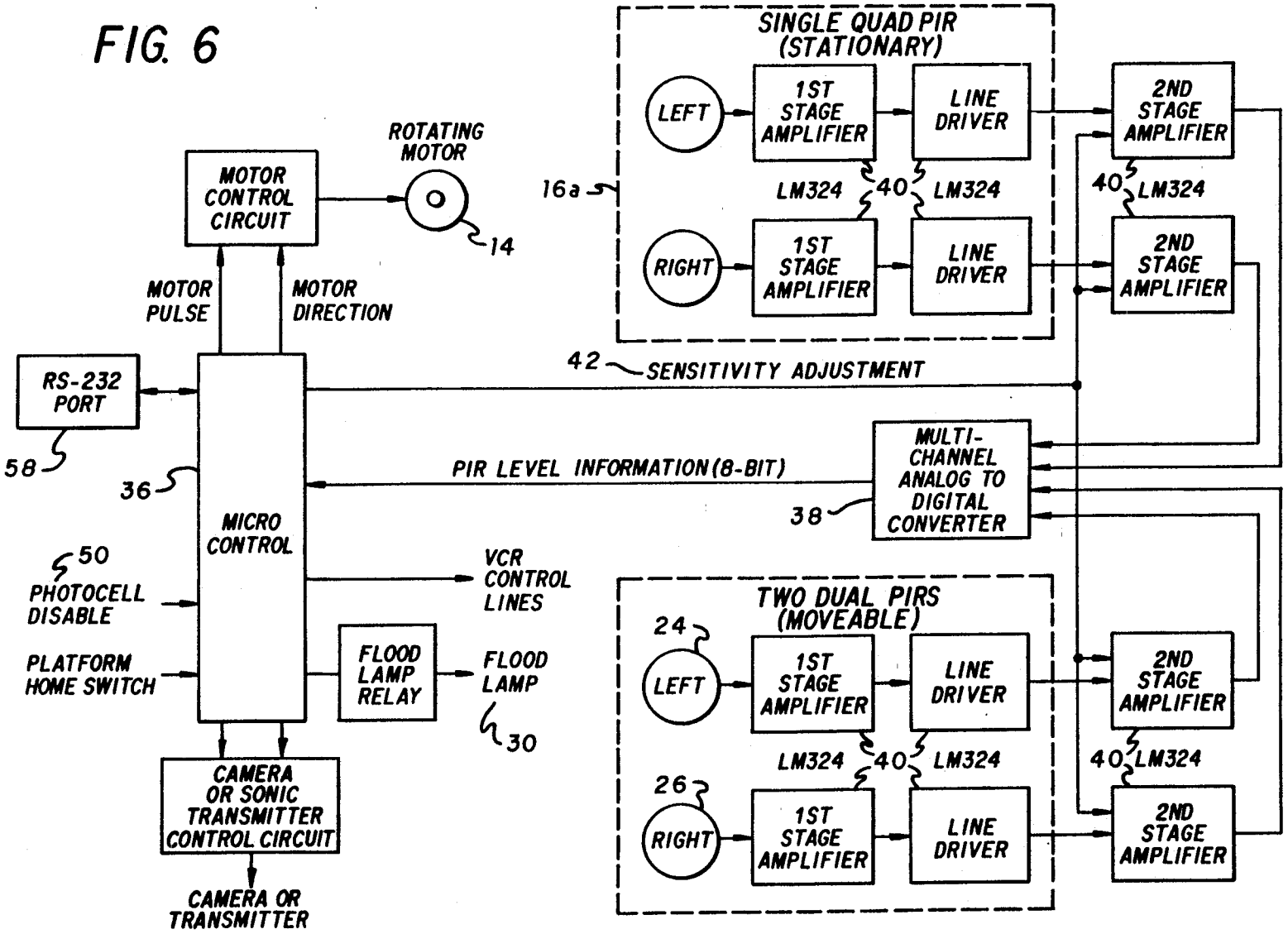
FIG. 6 is a block diagram of the circuitry for the operation of the present invention.

FIG. 6 discloses a block diagram of the circuitry of the present invention. A microcontroller 36 serves as a central input and output for the circuitry of device 10, and accordingly receives input from PIRs 16 and/or 24 and 26 by way of an analog/digital converter 38, which serves to process the analog signals from PIRs 16*a* and/or 24 and 26 to a digital signal acceptable to microcontroller 36. Each PIR device 16, 24 and 26 incorporates further circuitry providing for amplification and processing of the signals, such as the LM324 devices 40 shown in FIG. 6. When the signal has been amplified and processed by means of the LM324 devices 40, it passes to the analog/digital converter for conversion to an appropriate digital format for processing by microcontroller 36. The analog/digital converter 36 may also provide approximate information as to the distance of an intruder based upon signal strength, in cooperation with appropriate algorithms programmed into microcontroller 36.

Normally, PIRs 16, 24 and 26 are providing little or no signal to microcontroller 36, assuming that no infrared source has been detected by PIR 16. A sensitivity adjustment 42 provides for the adjustment of the circuitry as desired in order to prevent microcontroller 36 from reacting to spurious signals, background radiation, small animals, etc. However, PIR 16 is capable of scanning a relatively wide field of view (nominally some 180 degrees) in its stationary position, due to a wide angle fresnel lens 44 incorporated in front of PIR 16 as shown in FIGS. 4A and 4B. Any infrared source of the proper frequency will be detected by PIR 16 throughout the wide angle field of view provided by fresnel lens 44, and that signal will be processed by components 40, 38 and 36 as described above.

Assuming that an intruder provides an infrared source of proper frequency and sufficient magnitude to override the preset sensitivity threshold and thus trigger microcontroller 36, the following will occur: Microcontroller 36 will determine which side of the stationary quad PIR 16*a* of FIG. 4A (or which of the two dual PIRs 16*b* and 16*c* of FIG. 4B) is providing the incoming signal, and will provide an appropriate signal to stepper motor 14 to cause rotary portion 20 to rotate in the appropriate direction. Duplication of signal input to both sides of PIR 16*a*, or to both PIRs 16*b* and 16*c*, is obviated by means of a center barrier 46 which divides the field of view of PIR 16*a*, or PIRs 16*b* and 16*c*, to prevent undue overlap.

As rotary portion 20 rotates toward the direction commanded by microcontroller 36, the PIR 24 or 26 (or side of PIR 16*a*, should a quad PIR be incorporated in rotary portion 20) leading in the direction of rotation of rotary portion 20 will next detect the intruder. It will be understood that PIRs 24 and 26, or a quad PIR 16*a* incorporated in rotary portion 20, will be equipped with fresnel lenses 48 which provide a relatively narrow field of view on the order of some 30 to 60 degrees.

As an example, assume that microcontroller 36 has been provided with a signal indicating that the left side of stationary PIR 16*a* of FIG. 4A, or the left PIR 16*b* of FIG. 4B, has detected an infrared source sufficient to exceed the minimum level preset by sensitivity control 42. In this event, microcontroller 36 will command stepper motor 14 to rotate to the left (counterclockwise) in order to cause rotary PIR 24 to seek out the infrared source. Thus, tracking device 10 does not require that rotating PIR 24 be in actual alignment with a stationary PIR 16*a* or 16*b* in order to operate, as in the case of other devices which require alignment of fixed and rotating PIRs or other detection devices.

Stop means are provided in order to prevent rotary portion 20 from rotating past a preset limit to either side. These stop means may comprise a stationary magnetic sensor 52 and ferrous pins 54 mounted on rotary portion 20, or other means such as a photoelectric cell and opaque means to block the light from such a photoelectric cell or an electrical contact switch. In the event that rotary portion 20 is rotated sufficiently far to the left that pin 54 is immediately adjacent to magnetic sensor 52, sensor 52 will provide a signal to microcontroller 36 in order to deactivate and reverse stepper motor 14.

Assuming that the stop limit described above is not reached, when the first or left rotary PIR 24 is aligned with the infrared source microcontroller 36 will receive a signal to so indicate and will continue to drive stepper motor 14 in order to align the second or right PIR 26 with the infrared source. It will be understood that there will be some slight overlap in the fields of view of the two rotary PIRs 24 and 26 (or the sides of a single quad PIR, if so equipped), and thus all PIR devices 16*a* or 16*b* and 16*c*, and 24 and 26, will be aligned with the infrared source and provide appropriate signals to microcontroller 36 to so indicate.

In the event that the infrared source moves to the right relative to the field of view of device 10, microcontroller 36 will note that the two rotary PIRs 24 and 26 are no longer both aligned with the infrared source and will command stepper both 14 to reverse direction to the right in order to realign rotary PIRs 24 and 26 with the infrared source. Thus, device 10 is capable of continually tracking an infrared source as described above.

Assuming that the two rotary PIRs 24 and 26, as well as at least one of the stationary PIRs 16*a*, 16*b*, or 16*c*, are aligned with the infrared source at this point, microcontroller 36 will stop stepper motor 14 and will send a signal to activate camera 28 to record the intruder. Light 30 may also be activated in the event of darkness; a photocell 50 may be used to deactivate light 30 if sufficient ambient light is available. Light 30 may be physically incorporated with the remaining apparatus of device 10, or alternatively may be positioned separately.

Alternatively, an infrared camera may be incorporated within device 10 in order to preclude the requirement for a light 30 and the associated power demands of such a light 30. Other devices capable of providing visual images in low light, e.g. "starlight scopes," may also be incorporated in combination with the present invention in order to preclude the need for a light 30.

Camera 28 may be used to provide a signal to a remote monitor at a security post, and/or a remote video recorder in order to record the appearance of the intruder, by means of output cable 56. Cable 56 may comprise a bundle including a power supply cable and additional relay cables providing electronic links between cooperating devices 10. Such a signal provided to a remote security post may of course also be used to provide an alarm to alert appropriate personnel.

It will be evident from the foregoing that device 10 is a most useful tracking device, providing relative economy due to the need for only a single camera 28 and eliminating the need for a human security person at each point of surveillance. The ability to link a number of devices 10 together to provide a surveillance network which might be monitored by only a single security person, is provided by cooperating input and output cables 56 which may be linked to the microcontrollers 36 of other devices 10 by means of RS-232 ports 58, as is well known in the art. Device 10 provides additional advantages, in that it requires only enough electrical power to operate the basic electronic circuitry while other components such as motor 14, camera 28 and light 30 may remain deactivated until actuated by microcontroller 36. This relatively small requirement for electrical power permits practical operation of device 10 using battery power.

Alternative embodiments of device 10 may be provided, which will be useful as a deterrent to animals in areas in which they are not desired. Raiding animals have been known to be extremely destructive to crops in agricultural areas, and most of the deterrents used against them lose their effectiveness over a period of time due to their predictability, or are not practicable for various reasons which may not be compatible with the ecology (poisons, guns, etc.). Devices 10*a* and 10*b* serve to overcome the above problems, and in fact may be further used to deter entry to a secure area by unauthorized personnel. Device 10*a* incorporates a sonic emitter 32 secured to rotary portion 20, thus providing that sonic emitter 32 may be aimed at an intruder in the manner discussed in detail above for device 10. It will be seen that the sonic emitter 32 will not be activated until all three of the PIRs 16, 24 and 26 of device 10*b* have been trained on the intruder and are receiving infrared signals in order to trigger microcontroller 36, as in device 10 described above. Thus, sonic emitter 32 will operate only on an intermittent and on demand basis, rather than on a periodic, timed basis as is the case with many other deterrent devices. The unpredictability provided by the present invention serves as a more effective deterrent than other means.

Device 10*b* may serve along the same lines, but incorporates a directional laser or strobe light 34 to provide a sudden and relatively bright flash of light as a deterrent. The remaining principles of operation are essentially identical to those of devices 10 and 10*a*. Such a laser or strobe light 34 may prove more desirable in suburban areas, where loud or sudden noises and sounds may be undesirable to the surrounding population. Obviously, such devices as sonic emitter 32 and/or light 34 may be incorporated in combination with device 10, in order to frighten intruders from the area but still providing a video record of the intruder.

It is to be understood that the present invention is not limited to the sole embodiment described above, but encompasses any and all embodiments within the scope of the following claims.

What is claimed is:

1. An automatically activated and operated passive infrared tracking device for the detection and continual tracking of an intruder, comprising;

a stationary portion including passive detectors for the detection of radiation emission by said intruder and a stepper motor, a rotatable portion mounted to said stepper motor and including passive detectors for the detection of radiation emission by said intruder and video monitoring means, control means including circuitry for determination of the general direction and range of said intruder by said stationary portion passive detectors, operation of said stepper motor to cause said rotatable portion to rotate to align at least one of said rotatable portion passive detectors with said intruder and to continually track said intruder, verification of said intruder by said rotatable portion passive detectors, and activation of said video monitoring means, and one or more of said tracking devices linked with one another to provide coverage to a remote security post.

2. The tracking device of claim 1 wherein;

said stationary portion passive detectors comprise integrated and cooperative quadruplex passive infrared sensors.

3. The tracking device of claim 1 wherein;

said rotatable portion passive detectors comprise integrated and cooperative quadruplex passive infrared sensors.

4. The tracking device of claim 1 wherein;

said stationary portion passive detectors comprise a pair of dual passive infrared sensors.

5. The tracking device of claim 1 wherein;

said rotatable portion passive detectors comprise a pair of dual passive infrared sensors.

6. The tracking device of claim 1 including;

light means cooperating with said video monitoring means.

7. An automatically activated and operated passive infrared tracking device for the detection and continual tracking of an intruder, comprising;

a stationary portion including passive detectors for the detection of radiation emission by said intruder and a stepper motor, a rotatable portion mounted to said stepper motor and including passive detectors for the detection of radiation emission by said intruder and intruder deterrent means, control means including circuitry for determination of the general direction and range of said intruder by said stationary portion passive detectors, operation of said stepper motor to cause said rotatable portion to rotate to align at least one of said rotatable portion passive detectors with said intruder and to continually track said intruder, verification of said intruder by said rotatable portion passive detectors, and activation of said deterrent means, and one or more of said tracking devices linked with one another to provide coverage to a remote security post.

8. The tracking device of claim 7 wherein;

said deterrent means comprises a sonic emitter.

9. The tracking device of claim 7 wherein;

said deterrent means comprises a directional laser.

10. The tracking device of claim 7 wherein;

said deterrent means comprises a strobe light.

11. The tracking device of claim 7 wherein;

said stationary portion passive detectors comprise integrated and cooperative quadruplex passive infrared sensors.

12. The tracking device of claim 7 wherein;

said rotatable portion passive detectors comprise integrated and cooperative quadruplex passive infrared sensors.

13. The tracking device of claim 7 wherein;

said stationary portion passive detectors comprise a pair of dual passive infrared sensors.

14. The tracking device of claim 7 wherein;

said rotatable portion passive detectors comprise a pair of dual passive infrared sensors.

15. The tracking device of claim 1 wherein:

said rotatable portion passive detectors are disposed immediately adjacent one another and provide contiguous fields of view.

16. The tracking of claim 7 wherein:

said rotatable portion passive detectors are disposed immediately adjacent one another and provide contiguous fields of view.

* * * * *